US007445083B2

(12) United States Patent
Wu

(10) Patent No.: US 7,445,083 B2
(45) Date of Patent: Nov. 4, 2008

(54) AUTOMOTIVE MUFFLER

(76) Inventor: Ching-Lin Wu, No.47, Jiansing Rd., Taoyuan City, Taoyuan County 330 (TW)

( * ) Notice: Subject to any disclaimer, the term of this patent is extended or adjusted under 35 U.S.C. 154(b) by 4 days.

(21) Appl. No.: 11/783,312

(22) Filed: Apr. 9, 2007

(65) Prior Publication Data

US 2008/0245606 A1 Oct. 9, 2008

(51) Int. Cl.

| | |
|---|---|
| ***F01N 1/08*** | (2006.01) |
| ***F01N 1/10*** | (2006.01) |
| *F01N 1/00* | (2006.01) |
| *F01N 1/24* | (2006.01) |
| *F01N 1/02* | (2006.01) |

(52) U.S. Cl. ..... 181/269; 181/272; 181/275; 181/267; 181/257; 181/251

(58) Field of Classification Search ..... 181/269, 181/272, 275, 268, 267, 257, 249, 251, 227, 181/228, 250, 253, 258, 266, 273, 276, 252, 181/256; 60/312, 322

See application file for complete search history.

(56) References Cited

U.S. PATENT DOCUMENTS

| | | | | | |
|---|---|---|---|---|---|
| 1,076,494 | A | * | 10/1913 | Galaine | 181/253 |
| 1,927,213 | A | * | 9/1933 | Mackenzie et al. | 181/258 |
| 2,034,186 | A | * | 3/1936 | Heath | 181/253 |
| 2,036,138 | A | * | 3/1936 | Haas | 181/253 |
| 2,088,576 | A | * | 8/1937 | Compo | 181/275 |
| 2,150,768 | A | * | 3/1939 | Hedrick | 181/275 |
| 2,176,615 | A | * | 10/1939 | Starkweather et al. | 181/250 |
| 2,274,461 | A | * | 2/1942 | Rauen | 181/273 |
| 2,402,078 | A | * | 6/1946 | Peters | 181/266 |
| 2,514,520 | A | * | 7/1950 | Sauer | 181/253 |
| 2,567,568 | A | * | 9/1951 | Lievense et al. | 181/272 |
| 2,764,250 | A | * | 9/1956 | Jeffords | 181/246 |
| 3,685,616 | A | * | 8/1972 | Malkiewicz | 181/266 |
| 3,712,030 | A | * | 1/1973 | Priest | 96/118 |
| 4,318,720 | A | * | 3/1982 | Hoggatt | 96/135 |
| 4,595,073 | A | * | 6/1986 | Thawani | 181/265 |
| 5,266,754 | A | * | 11/1993 | Swift | 181/230 |
| 5,661,272 | A | * | 8/1997 | Iannetti | 181/256 |

(Continued)

FOREIGN PATENT DOCUMENTS

| | | | |
|---|---|---|---|
| JP | 05026025 | A * | 2/1993 |

*Primary Examiner*—Edgardo San Martin
(74) *Attorney, Agent, or Firm*—Rosenberg, Klein & Lee

(57) ABSTRACT

An automotive muffler includes an external tube consisting of a first widened portion, a first tapering portion, and a first narrow portion, the first widened section having a sealing wall with a through hole at the front end thereof; an internal tube consisting of a second widened portion, a second tapering portion, and a second narrow portion, the internal tube being disposed within the external tube, a plurality of vent holes being formed in the wall of the second widened portion; an internal guide tube consisting of a third widened portion, a third tapering portion, and a third narrow portion, the internal guide tube being disposed within the internal tube, a plurality of vent holes being formed in the wall of the third widened section that is disposed within the internal pipe; and a plurality of partitions interposed between the first widened section and the second widened section as well as between the second widened section and the third widened section. In this way, a reduced pumping loss and an increase output horsepower of the engine may be achieved.

4 Claims, 5 Drawing Sheets

U.S. PATENT DOCUMENTS 5,902,970 A * 5/1999 Ferri ..... 181/249
5,962,821 A * 10/1999 Iannetti ..... 181/256
6,116,376 A * 9/2000 Chu ..... 181/256
6,302,235 B1 * 10/2001 Matherne ..... 181/268
6,510,921 B2 * 1/2003 Price ..... 181/264
7,380,397 B2 * 6/2008 Chang ..... 60/324
2007/0227808 A1 * 10/2007 Sakurai et al. ..... 181/249
2007/0227810 A1 * 10/2007 Sakurai et al. ..... 181/251

* cited by examiner

AUTOMOTIVE MUFFLER

BACKGROUND OF THE INVENTION

1. Field of the Invention

The present invention relates to an automotive muffler, and more particularly to an automotive muffler operating both in a circuitous and in a straight way. Meanwhile, the output horsepower can be enhanced.

2. Description of the Related Art

The exhaust ejected from the internal combustion engine and directly injected into the atmosphere will produce a harsh noise since the gas pressure of the exhaust is suddenly reduced from a high level to an atmospheric level. Thus, the exhaust has to pass through a sound-deadening unit for reducing the pressure and the frequency of the exhaust, thereby efficiently lowering the exhaust noise.

A conventional automotive muffler 10, as shown in FIG. 1, operates in a circuitous way. The circuitous muffler includes partitions 12 within a cylindrical body 11 for separating a plurality of gas chambers 13. A plurality of the air guide tubes 14 are interconnected to one another within the gas chambers 13 according to a circuitous design. A plurality of vent holes 141 are formed in the air guide tubes 14 according to different requirements. In this way, the exhaust passing through the vent holes 141 is expanded. Moreover, the high-pressure exhaust ejected from the engine and illustrated by arrows in FIG. 1 passes through all of the air guide tubes 14 and is expanded within all of the gas chambers 13 for ensuring the pressure relief and achieving the sound-deadening effect.

As shown in FIG. 2, a straight-way type muffler 20 includes a cylindrical body 21 in which an internal tube 22 with a plurality of vent holes 221 is disposed. The internal tube 22 is enclosed by the cylindrical body 21. A sound-absorbing chamber defined by the periphery of the internal tube 22 and the internal wall of the cylindrical body 21 is filled with sound-absorbing material 23. In this way, the exhaust ejecting from the engine and passing through the internal tube 22 will be expanded by means of the vent holes 221 for reducing the exhaust pressure. Meanwhile, the sound-absorbing material 23 filled within the sound-absorbing chamber is used to absorb the exhaust sound. In this way, a sound-deadening effect is achieved.

The above-mentioned automotive mufflers have their own advantages and disadvantages. The circuitous muffler has the problem of great return pressure due to the complicated flowing path of exhaust. However, it has an excellent sound-deadening effect. The straight-way type muffler 20 has smaller return pressure and is beneficial for high-velocity gas exhaust due to the simple and smooth exhaust path. However, the straight-way type muffler 20 has difficulties in absorbing the exhaust sound, thereby causing noise problem.

In fact, the engine is an air pump. Its efficiency greatly depends upon how easily the gas is injected and ejected. The resistance in ejecting and injecting the gas is called as "pumping loss". Evidently, the smaller the resistance is, the less the pumping loss is caused. As a result, a greater horsepower can be achieved. The exhaust system must maintain the least resistance of the exhaust gas flow for maximizing the power horse. This resistance prevents the exhaust from blowing out of the engine, thereby resulting in dilution of the fresh oil vapor entering into the engine afterward. In other words, one part of the exhaust remains within the cylinder and is mixed with fresh oil vapor, thereby affecting the performance of engine. Even, a return pressure will be created when the resistance becomes greater. The engine must give more effort to eject the exhaust from the cylinder. This is one of the sources of the pumping loss.

Accordingly, the conventional circuitous muffler and the straight-way type muffler have their own advantages and disadvantages. They can not fulfill the requirements of low noise and maximal horsepower. Accordingly, they require further improvements.

SUMMARY OF THE INVENTION

It is a primary object of the invention to eliminate the above-mentioned drawbacks and to provide an automotive muffler that ensures the decrease of the return pressure according to the increase of the exhaust velocity.

It is another object of the invention to provide an automotive muffler that achieves the circuitous sound-deadening effect and guarantees the least resistance of the exhaust gas flow for obtaining an optimal engine efficiency. Meanwhile, the output horsepower can be raised at more than 20%.

The principle employed in the invention lies in that the exhaust gas flow field can be expanded to different sound-absorbing chambers when the gas ejected from the engine is injected into a muffler. Meanwhile, the sound-absorbing chamber consists of several tubes interconnected in the axial direction. All of the tubes have a widened inlet section and a narrow outlet section to fulfill the requirements of Venturi tube and to create the Venturi tube effect. According to Bernoulli's equation, $$Q=\phi 1\times V1=\phi 2\times V2$$

the change of the flow velocity can be determined.

Under the condition that the exhaust at the same flow rate Q passes through the front and rear through holes, the velocity V2 increases due to decrease of the diameter of the through hole ϕ2. In this way, an enhanced flow velocity within the sound-deadening tube can be achieved. Meanwhile, such a flow velocity results in a suction effect around the jet flow nozzle. Therefore, the exhaust gas flow field within the external tube can be moved. In other words, the exhaust may be rapidly ejected to create a "conduction action" after the exhaust within the tubes is expanded and sound-deadened. Accordingly, the pumping loss of the engine may be minimized for enhancing the horsepower without increase of the noise.

In order to achieve the above-mentioned objects, an automotive muffler includes:

a) an external tube consisting of a first widened portion, a first tapering portion, and a first narrow portion, the first widened section having a sealing wall with a through hole at the front end thereof;

b) an internal tube consisting of a second widened portion, a second tapering portion, and a second narrow portion, the internal tube being disposed within the external tube in such a manner that the front end of the second widened section is compressed against the sealing wall and the rear end of the second narrow section is extended into the first narrow portion, a plurality of vent holes being formed in the wall of the second widened portion;

c) an internal guide tube consisting of a third widened portion, a third tapering portion, and a third narrow portion, the internal guide tube being disposed within the internal tube in such a manner that the front end of the third widened section projects out of the through holes and the rear end of the third narrow section is extended into the second narrow portion, a plurality of vent holes being formed in the wall of the third widened section that is disposed within the internal pipe; and d) a plurality of partitions interposed between the first widened section and the second widened section as well as between the second widened section and the third widened section for separating several sound-absorbing chambers with different sizes and in different positions.

BRIEF DESCRIPTION OF THE FIGURES

The accomplishment of this and other objects of the invention will become apparent from the following descriptions and its accompanying figures of which.

DETAILED DESCRIPTION OF THE PREFERRED EMBODIMENT

Figure 1:
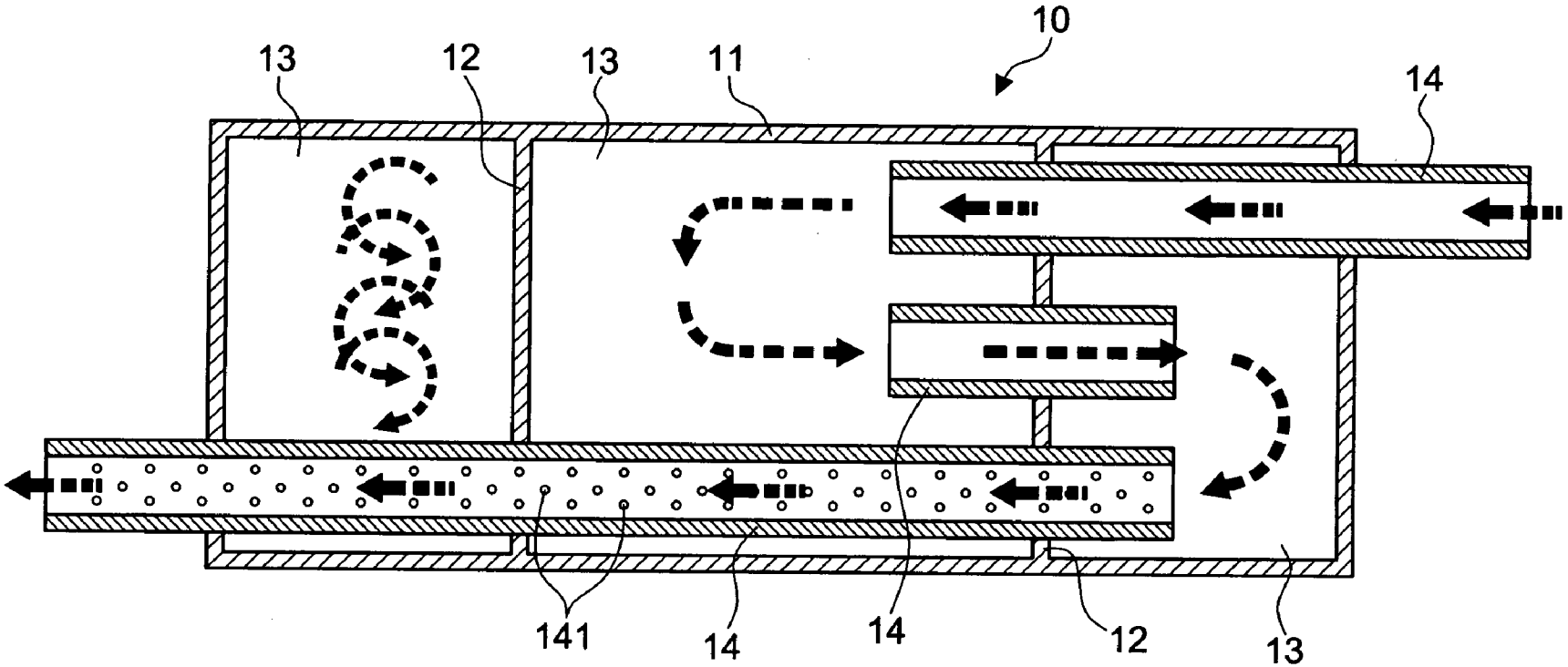
FIG.1 PRIOR ART
FIG. 1 is a schematic drawing of the structure of a circuitous muffler.
Figure 2:
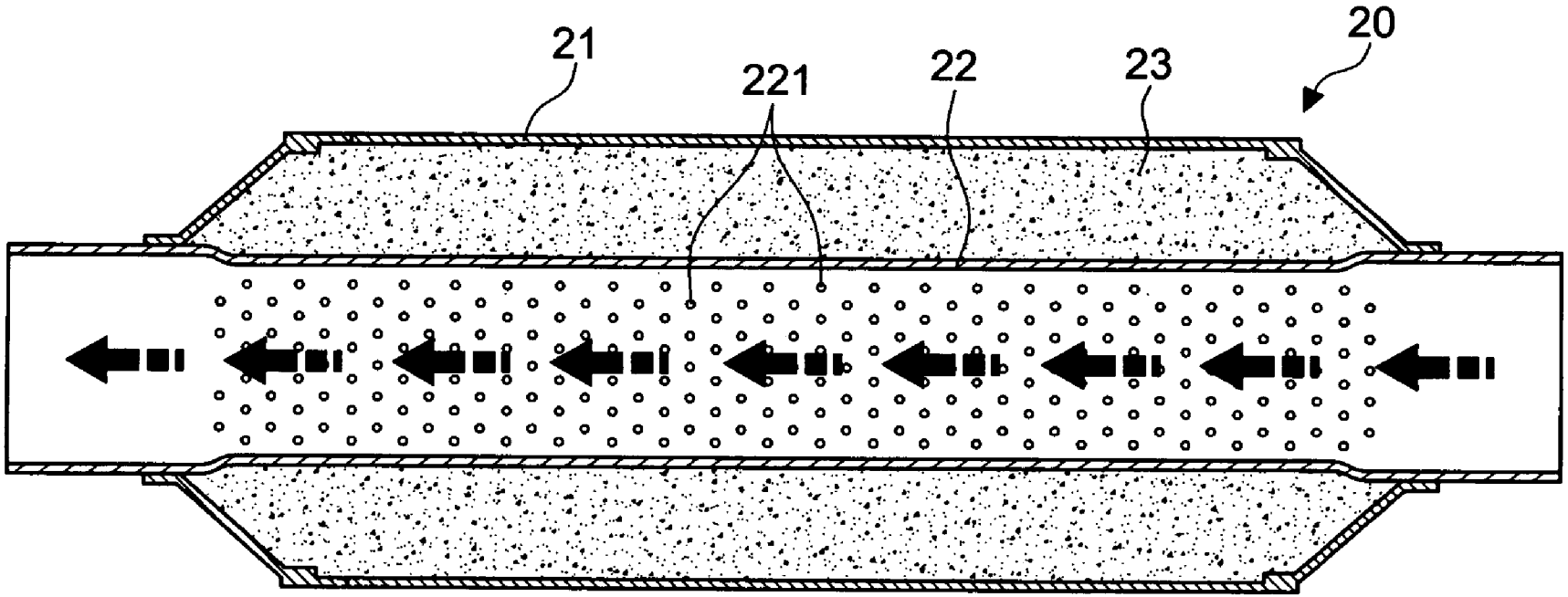
FIG.2 PRIOR ART
FIG. 2 is a schematic drawing of the structure of a straight-way type muffler.
Figure 3:
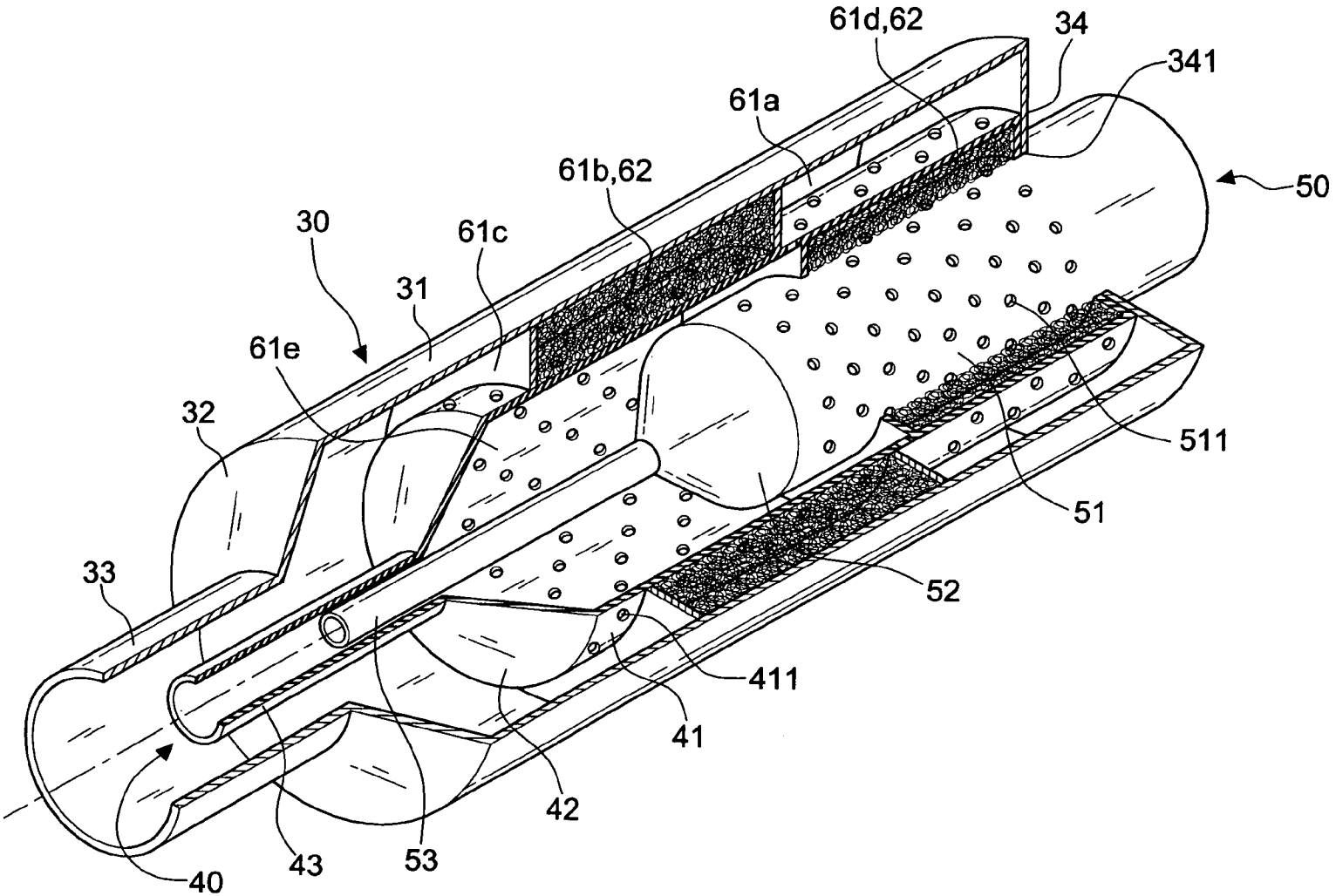
FIG. 3 is a perspective view of the structure of the invention in half-section.
Figure 4:
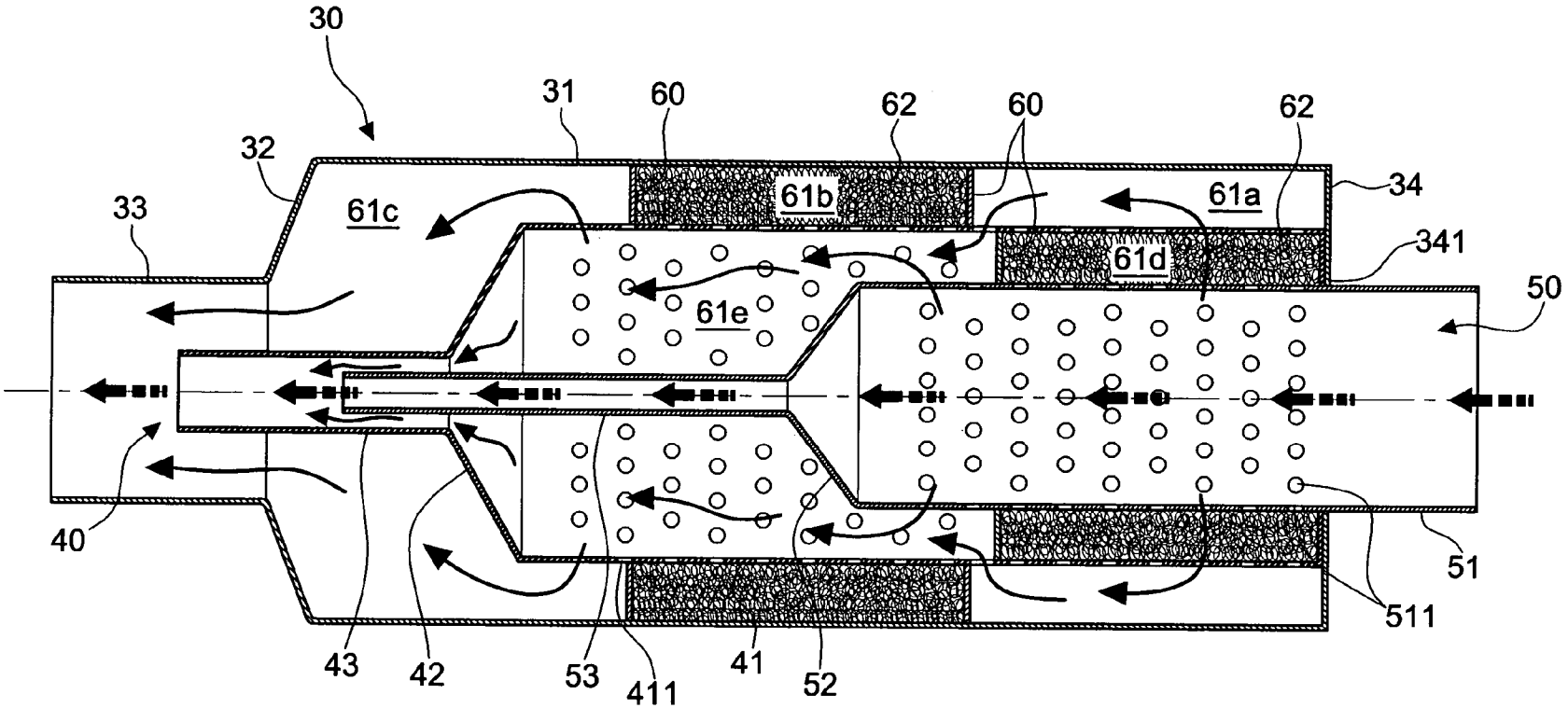
FIG. 4 is a full-sectional view of the structure of the invention.

Referring to FIGS. 3 and 4, an automotive muffler in accordance with a preferred embodiment of the invention includes an external tube 30, an internal tube 40, an internal guide tube 50, and a plurality of partitions 60.

The external tube 30 consists of a first widened section 31, a first tapering section 32, and a first narrow section 33. The first widened section 31 includes a sealing wall 34 with a through hole 341 at the front end thereof.

The internal tube 40 consists of a second widened section 41, a second tapering section 42, and a second narrow section 43. The internal tube 40 is disposed within the external tube 30 in such a manner that the front end of the second widened section 41 is compressed against the sealing wall 34 and the rear end of the second narrow section 43 is extended into the first narrow section 33. Besides, a plurality of vent holes 411 are formed in the wall of the second widened section 41.

The internal guide tube 50 consists of a third widened section 51, a third tapering section 52, and a third narrow section 53. The internal guide tube 50 is disposed within the internal tube 40 in such a manner that the front end of the third widened section 51 projects out of the through holes 341 and the rear end of the third narrow section 53 is extended into the second narrow section 43. Meanwhile, a plurality of vent holes 511 are formed in the wall of the third widened section 51 that is disposed within the internal tube 40.

The partitions 60 are interposed between the first widened section 31 and the second widened section 41 as well as between the second widened section 41 and the third widened section 51 for creating several sound-absorbing chambers 61*a*, 61*b*, 61*c*, 61*d*, 61*e* with different sizes and in different positions. The sound-absorbing chambers 61*a*, 61*b*, 61*c*, 61*d*, 61*e* are filled with sound-absorbing material 62 like sound-deadening cotton, fiber wire or the combination of the both.

The number of the aforementioned internal tubes 40 can be selected according to different requirements. One or two internal tubes 40 can be provided for heavy vehicles having a large amount of exhaust gas. For motorcycles with a small amount of exhaust gas, the internal guide tube 50 in combination either with the external tube 30 or with the internal tube 40 is enough.

Based upon the above-mentioned configuration, the sound-deadening effect of the invention can be achieved by the following ways.

1. The exhaust gas escaped from the engine pass through the vent holes 511 of the internal guide tube 50. The internal sound-absorbing chambers 61*d*, 61*e* will be expanded first. Thereafter, the exhaust gas passes through the vent holes 411 of the internal tube 40 to expand the external sound-absorbing chambers 61*a*, 61*b*, 61*c*. In this way, the pressure of the exhaust gas may be reduced. Moreover, the sound-absorbing material 62 is employed to absorb the sound of the exhaust gas.

2. The engine exhaust air not flowing through the vent holes 511 of the internal guide tube 50 will be ejected from the third narrow section 53 of the internal guide tube 50 to the second narrow section 43 of the internal tube 40 and then to the first narrow section 33 of the external tube 30. In this way, the exhaust tube will be expanded to reduce the expansion action of the exhaust pressure. In addition, the exhaust air ejected and expanded in the rear sound-absorbing chambers 61*c*, 61*e* may be discharged.

Referring again to FIG. 4 in which the exhaust gas flow field is shown by arrows, the sound-deadening action in accordance with the invention takes place in a circuitous and a straight way. When the exhaust is escaped from the engine at a low velocity, the gas ejected and expanded in the sound-absorbing chambers 61*c*, 61*e* has a low flow velocity, thereby creating a greater circuitous effect. Accordingly, a large return pressure is generated to enhance the torsion. When the exhaust is escaped from the engine at a high velocity, the gas ejected and expanded in the sound-absorbing chambers 61*c*, 61*e* has a high flow velocity, thereby creating a small and straight-through return pressure effect. In addition, the sound-absorbing chambers 61*a*, 61*b*, 61*c*, 61*d*, 61*e* divided by several partitions 60 in different sizes and positions as well as filled with sound-absorbing material 62 allow for absorbing the sound of escaping gases in different vocal range. Therefore, the return pressure will be decreased with the increase of the exhaust velocity. Moreover, the sound-deadening effect is achieved.

Figure 5:
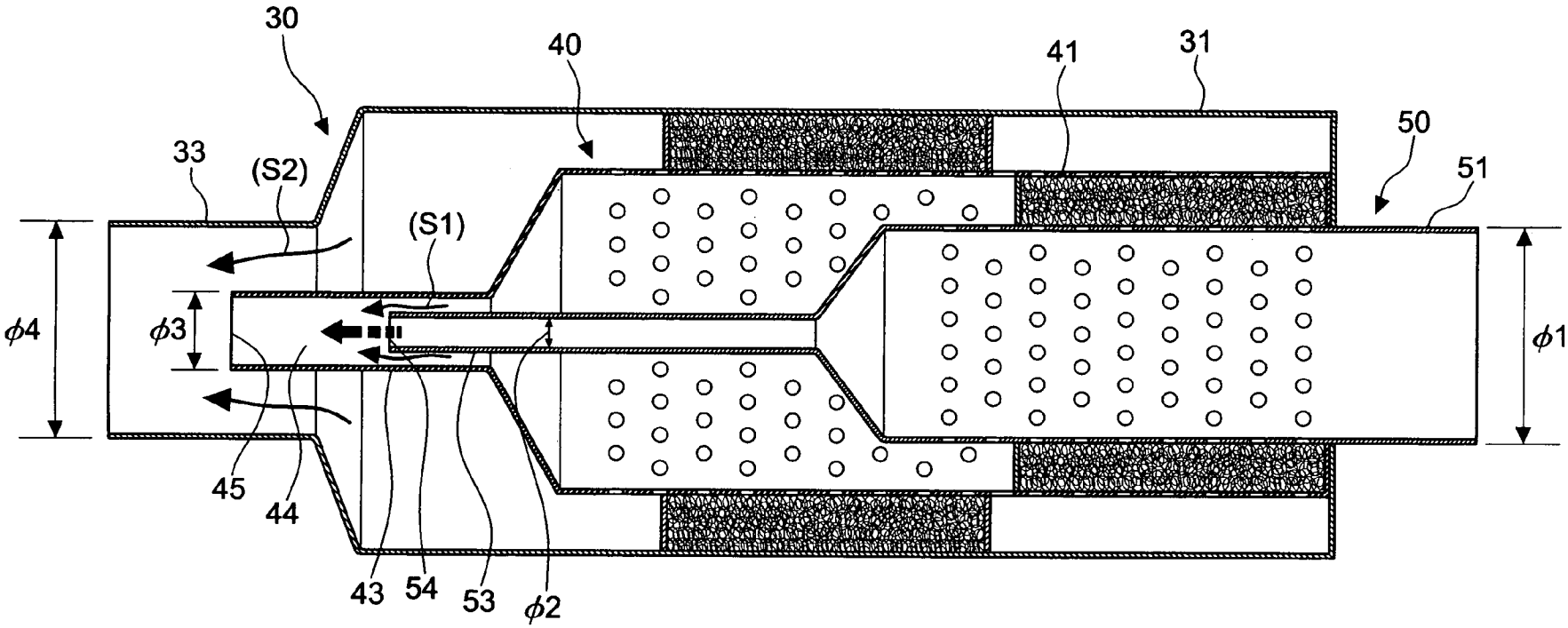
FIG. 5 is a schematic drawing for illustrating the Venturi tube effect in FIG. 4.

Referring to FIG. 5 in which the Venturi tube effect of all tubes in FIG. 4 is shown, the inlet (the third widened section 51) of the internal guide tube 50 in accordance with the embodiment has a diameter $\phi 1$ of 50 mm while the outlet (the first narrow section 33) of the external tube 30 has a diameter $\phi 4$ of 50 mm as well. However, the diameter should not be restricted thereto. The invention is substantially characterized in that the second narrow section 43 of the internal tube 40 has a diameter $\phi 3$ of about 18 mm and is extended into the first narrow section 33. Meanwhile, the third narrow section of the internal guide tube 50 has a diameter $\phi 2$ of about 9 mm and is extended into the second narrow section 43, thereby creating the multiple Venturi tube effect. According to the Bernoulli's equation:

$$Q=\phi 1\times V1=\phi 2\times V2$$

The flow velocity V2 at the third narrow section 53 will be increased when the diameter of the internal guide tube 50 is reduced from the $\phi 1$ of 50 mm to the $\phi 2$ of 9 mm. Thus, a negative pressure state caused by a suction effect created at the periphery of a jet flow nozzle 54 is achieved. In this way, the exhaust gas flow field S1 within the internal tube 40 will be moved and the gas will be rapidly ejected into a combination chamber 44 within the second narrow section 43. At that time, the exhaust within the combination chamber 44 will be ejected from a second jet flow nozzle 45 into the first narrow section 33, thereby moving the exhaust gas flow field S2 within the external tube 30 in such a way that the exhaust injected into all sound-absorbing chambers for sound-deadening may be rapidly ejected by a smooth "conduction action". Accordingly, the pumping loss of the engine may be minimized for enhancing the horsepower.

A few data about the result of a performance test conducted on an automobile by Environmental Protection Bureau of Tao Yuan County, Taiwan on Feb. 6, 2007 are shown as follows:

1. Details of the Tested Automobile:

Brand: Mitsubishi FB511W

Engine type: L4

Year of leaving factory: July 1996

License number: L5-3508

Amount of air exhaust: 2835(C.C.)

Gross vehicle load: 3490 (kg)

Max. horsepower and revolutions per minute: 93/4000 (hp/rpm)

Ambient temperature and atmospheric pressure: 294.6/100.4 (k/kpa)

2. Test Results:

A conventional muffler and a muffler of the invention both pass the pollution test.

The horsepower ratio (%) of the vehicle employing the conventional muffler is 41% while the horsepower ratio (%) of the vehicle employing the muffler of the invention is 61%. More 20% of horsepower ratio is available by employing the muffler of the invention.

Based upon the above-mentioned test results on the automotive muffler of the invention, the output power horse can be raised and the engine performance can be improved without the increase of noise and pollution.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An automotive muffler, comprising:

a) an external tube consisting of a first widened portion, a first tapering portion, and a first narrow portion, the first widened section having a sealing wall with a through hole at the front end thereof;

b) an internal tube consisting of a second widened portion, a second tapering portion, and a second narrow portion, the internal tube being disposed within the external tube in such a manner that the front end of the second widened section is compressed against the sealing wall and the rear end of the second narrow section is extended into the first narrow portion, a plurality of vent holes being formed in the wall of the second widened portion;

c) an internal guide tube consisting of a third widened portion, a third tapering portion, and a third narrow portion, the internal guide tube being disposed within the internal tube in such a manner that the front end of the third widened section projects out of the through holes and the rear end of the third narrow section is extended into the second narrow portion, a plurality of vent holes being formed in the wall of the third widened section that is disposed within the internal pipe; and d) a plurality of partitions interposed between the first widened section and the second widened section as well as between the second widened section and the third widened section for separating several sound-absorbing chambers with different sizes and in different positions.

2. The automotive muffler as recited in claim 1, wherein the sound-absorbing chambers are filled with sound-absorbing material.

3. The automotive muffler as recited in claim 2, wherein the sound-absorbing material includes sound-deadening cotton, fiber wire or the combination of the both.

4. The automotive muffler as recited in claim 1, wherein the number of the internal tube varies according to different requirements.

* * * * *